US006250958B1

(12) United States Patent
Hsish

(10) Patent No.: US 6,250,958 B1
(45) Date of Patent: Jun. 26, 2001

(54) MODULAR ELECTRICAL CONNECTOR WITH ENHANCED ANTIELECTROMAGNETIC INTERFERENCE PERFORMANCE

(76) Inventor: Chunt-Iong Hsish, 4F, No. 26, Lane 347, Chung-An St., Lu Chou, Taipei Hsien (TW)

( * ) Notice: Subject to any disclaimer, the term of this patent is extended or adjusted under 35 U.S.C. 154(b) by 0 days.

(21) Appl. No.: 09/512,389

(22) Filed: Feb. 25, 2000

(51) Int. Cl.[7] ..... H01R 13/60
(52) U.S. Cl. ..... 439/541.5; 439/939
(58) Field of Search ..... 439/541.5, 607, 439/701, 76.1, 56, 939, 439

(56) References Cited

U.S. PATENT DOCUMENTS 5,709,554 * 1/1998 Savage, Jr. ..... 439/56
5,947,752 * 9/1999 Wu ..... 439/76.1
5,984,727 * 11/1999 Wu et al. ..... 439/607

* cited by examiner

*Primary Examiner*—Neil Abrams
*Assistant Examiner*—Phuong Dinh
(74) *Attorney, Agent, or Firm*—Bacon & Thomas, PLLC

(57) ABSTRACT

A modular electrical connector primarily used as an adapter in data communication between mainboard and peripheral devices of a personal computer (PC) comprising an insulated connector body and at least one connectors. Insulated connector body has a receiving space with first mating members each engaged with a second mating member of connector when connector and connector body are engaged. Also provided is a grounded member having holes on a side for allowing hollow cylindrical members of connector to be inserted through. Further, resiliently biased raised portions of grounded member are urged against rear panel of PC for electrically grounding the assembled connector as well as for preventing an electromagnetic interference.

6 Claims, 4 Drawing Sheets

MODULAR ELECTRICAL CONNECTOR WITH ENHANCED ANTIELECTROMAGNETIC INTERFERENCE PERFORMANCE

FIELD OF THE INVENTION

The present invention relates to an electrical connector, and more particularly to a modular electrical connector with enhanced antielectromagnetic interference performance.

BACKGROUND OF THE INVENTION

A conventional electrical connector of a personal computer (PC) is shown in FIG. 1. The electrical connector comprises a connector body 60 having a receiving space 601. At least one half-circular shaped cavities 61 are provided on a front side of connector body 60. Also provided are at least one connectors 70 each having a hollow cylindrical member 71 protruded from a front side and a grounded tab 72. The hollow cylindrical member 71 is secured in half-circular shaped cavity 61 when connector 70 is put on receiving space 601 of connector body 60. As such, it is required to manufacture receiving space 601, halfcircular shaped cavity 61, and connector 30 in a high precision process so as to be able to tightly fit among them. However, such high precision manufacturing process is complex in nature in most cases. Further, yield is low and accordingly assembly process is tedious and time consuming which in turn resulting in an increase of manufacturing cost.

Thus, it is desirable to provide an improved electrical connector to overcome the above drawbacks of prior art.

SUMMARY OF THE INVENTION

It is therefore an object of the present invention to provide an electrical connector for achieving a data communication with PC when mounted on mainboard comprising an insulated connector body and at least one connectors. Insulated connector body has a receiving space with at least one first mating members each engaged with a second mating member of connector when connector is put on insulated connector body. The electrical connector is simple in manufacture and easy in assembly, resulting in a reduction in cost.

It is another object of the present invention to provide an electrical connector further comprising grounded U-shaped member made of a piece of conductive metal having at least one holes on a horizontal section for allowing hollow cylindrical members of connector to be inserted through holes so as to prevent an electromagnetic interference to PC components.

It is still another object of the present invention to provide an electrical connector having at least one resiliently biased raised members urged against rear metal panel of PC for electrically grounding the assembled connector.

The above and other objects, features and advantages of the present invention will become apparent from the following detailed description taken with the accompanying drawings.

DETAILED DESCRIPTION OF PREFERRED EMBODIMENTS

Figure 1:
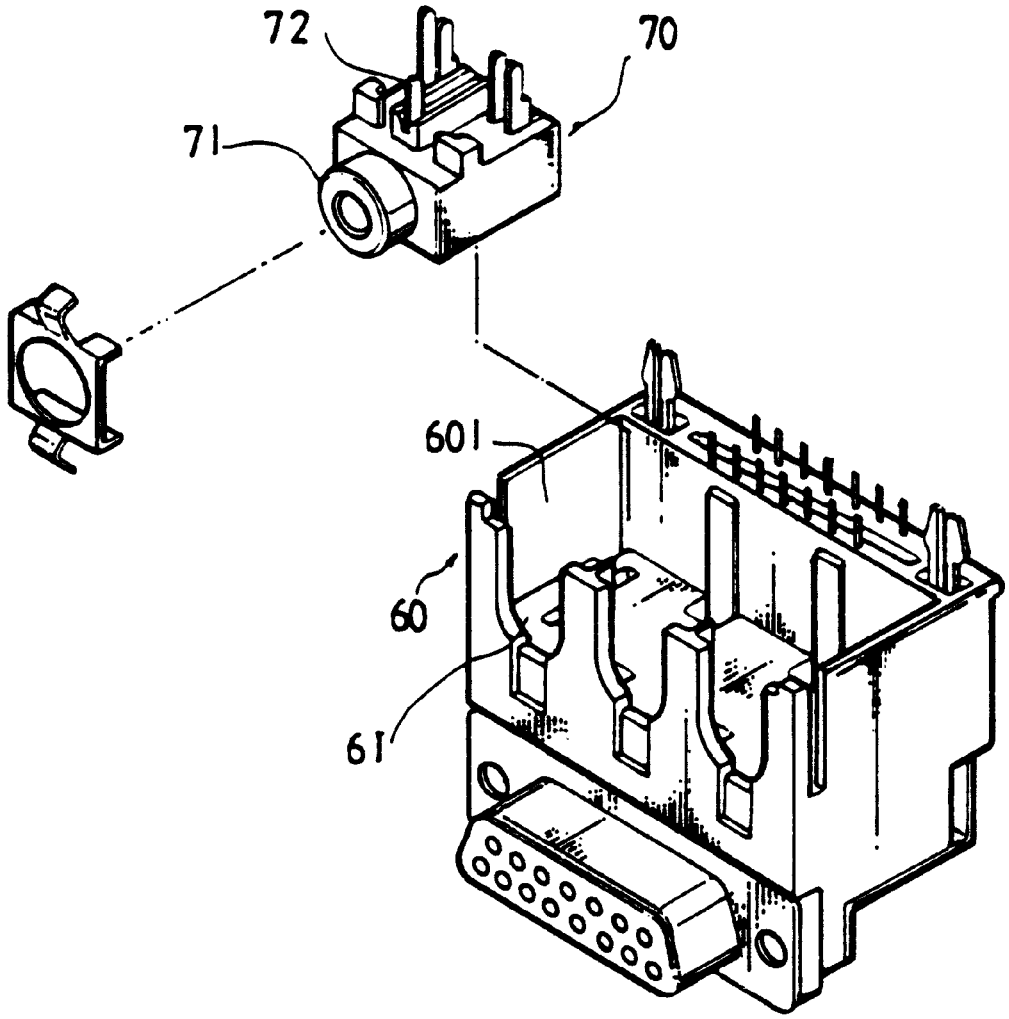
FiG 1 PRIOR ART
FIG. 1 is an exploded view of a conventional electrical connector.
Figure 2:
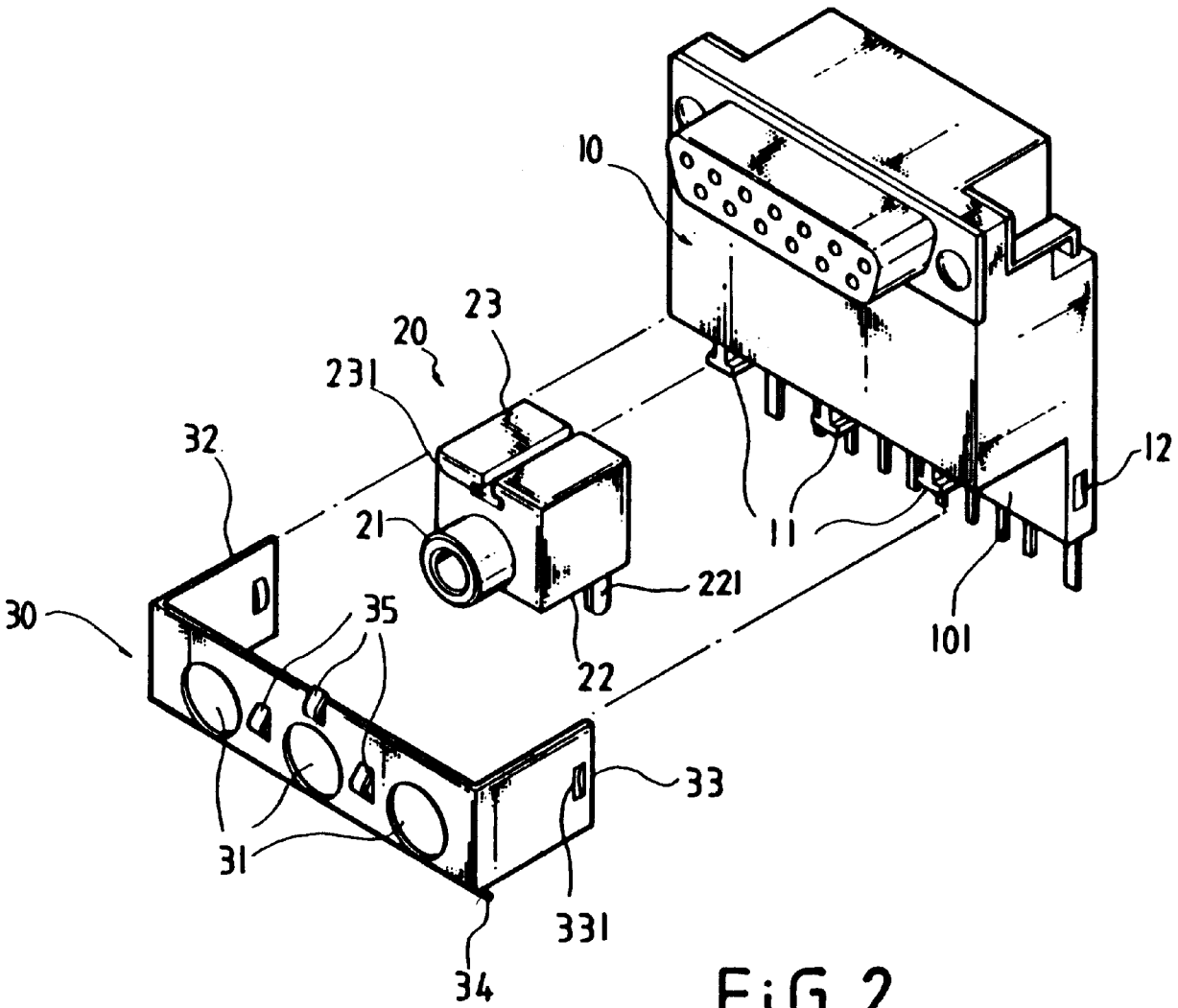
FIG. 2 is an exploded view of an electrical connector of a first preferred embodiment of the present invention.
Figure 3:
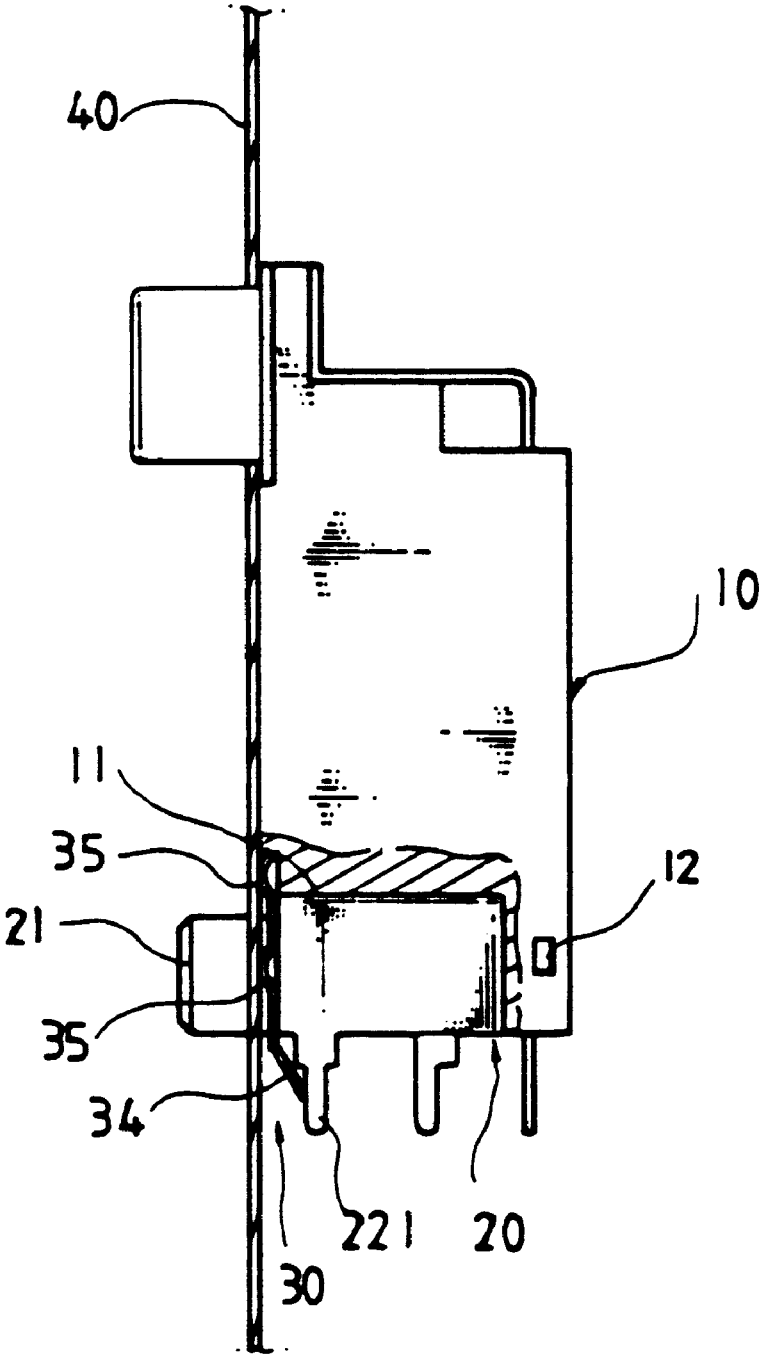
FIG. 3 is a side view, partially in section of the lower part of FIG. 2.

Referring to FIGS. 2–3, there is shown an electrical connector of first preferred embodiment primarily used as an adapter in data communication between mainboard and peripheral devices of PC. The electrical connector comprises an insulated connector body 10, at least one connectors 20, and a grounded member 30. Insulated connector body 10 has a receiving space 101 with at least one first mating members 11 (e.g., tabs) spaced apart in parallel thereon and two opposite recesses 12 on two sides.

Each connector 20 has a hollow cylindrical member 21 protruded from a front side for coupling with any other mating signal connectors, a grounded tab 221 protruded from a bottom surface 22 of connector 20, and a second mating member 231 (e.g., a groove) provided on a top surface 23. As such, first mating member 11 is secured within second mating member 231 when connector 20 is put on insulated connector body 10. It is apparent to those skilled in the art to design second mating member 231 as a tab and first mating member 11 as a groove.

Grounded member 30 is substantially shaped like a "U" made of a piece of conductive metal having at least one holes 31 on a horizontal section, a slanted first and second members 32 and 33 on two side surfaces both having a protrusion 331 on an internal side facing each other, a slanted portion 34 extended down from bottom of horizontal section, and at least one resiliently biased members 35 between holes 31 protruded from horizontal section.

In assembly, attach grounded member 30 to insulated connector body 10 which already with connectors 20 mounted on such that each hollow cylindrical member 21 is inserted through corresponding hole 31, protrusions 331 are 25 snapped into recesses 12, and slanted portion 34 is engaged against grounded tab 221 for better aligning holes 31 with hollow cylindrical members 21 in order to enhance the engagement of grounded member 30 with connector 20.

Further, rear metal panel 40 of a PC is urged against the resiliently biased members 35 for electrically grounding the assembled connector (see FIG. 3).

Figure 4:
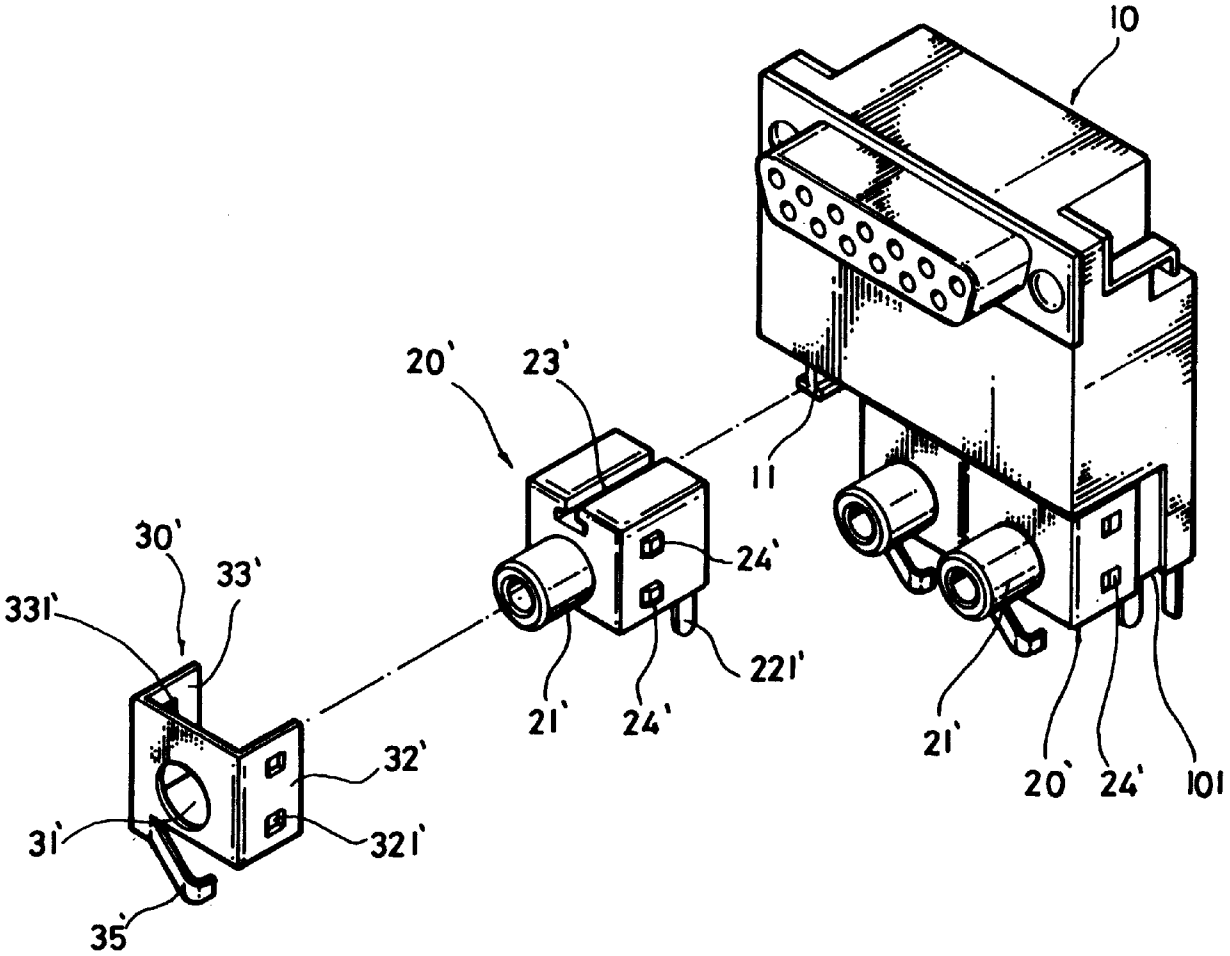
FIG. 4 is an exploded view of an electrical connector of a second preferred embodiment of the present invention.

Referring to FIG. 4, there is shown an electrical connector of second preferred embodiment comprising an insulated connector body 10, at least one connectors 20', and at least one grounded members 30'. Insulated connector body 10 has a receiving space 101 with at least one first mating members 11 (e.g., tabs) spaced apart in parallel thereon. Each connector 20' has a hollow cylindrical member 21' protruded from a front side, a grounded tab 221' protruded from a bottom surface, a second mating member 23' (e.g., a groove) provided on top surface, and two recesses 24' on each of two opposite sides. As such, first mating member 11 is secured within second mating member 23' when connector 20' is put on insulated connector body 10.

Each grounded member 30' is substantially shaped like a "U" made of a piece of conductive metal having at least one holes 31' on a horizontal section, a slanted first and second member 32' and 33' on two side surfaces both having two protrusion 321' and 331' on an internal side facing each other, and a hookshaped resiliently biased member 35' below hole 31' extended outwardly.

The assembly process of insulated connector body 10, connectors 20', and grounded members 30' is generally the same as first embodiment and thus a detailed description is omitted herein for the sake of brevity.

Further, rear metal panel 40 of a PC is urged against the resiliently biased members 35' for electrically grounding the assembled connector (not shown).

Note that hollow cylindrical member 21 and 21' are enclosed by a layer of conductive coating (not specifically shown) on its circumferential surface. The layer of conductive coating is integrally formed with grounded tab 221 or 221'. As such, the whole connector 20 or 20' is electrically conductive. As a result, the layer of conductive coating is electrically grounded through grounded member 30 or 30' when grounded member 30 or 30' is secured on connector 20 or 20'.

Further, such electrically grounded electrical connector is able to direct electromagnetic wave generated by an enabled PC to metal panel 40 thereof so as not to cause an electromagnetic interference to any electrical and electronic device within PC.

While the invention herein disclosed has been described by means of specific embodiments, numerous modifications and variations could be made thereto by those skilled in the art without departing from the scope of the invention set forth in the claims.

What is claimed is:

1. A modular electrical connector for a personal computer, the connector comprising:

(a) a connector body having a receiving space and at least one first mating member disposed within the receiving space;

(b) at least one connecting means having a grounded portion on a first side thereof, a second mating member on a second side thereof, a pair of hollow cylindrical members protruding from a third side thereof, and the at least one first mating member of the connector body being engagable with the second mating member of the at least one connecting means for securing the connecting means to the connector body so that the connector body may be mounted on a motherboard of a personal computer and provide data communication with the personal computer through the hollow cylindrical members; and (c) a grounded means in the form of a substantially U-shaped member having a horizontal section, the horizontal section including two holes for receiving the hollow cylindrical members there through, and at least one resiliently biased member between the holes of the horizontal section for engaging a rear panel of the personal computer and preventing electromagnetic interference.

2. The modular electrical connector of claim 1, wherein the connector body further includes a pair of opposite sides, each opposite side including a recess formed therein, each side of the U-shaped member including an inwardly directed protrusion, and the protrusions of the U-shaped member being engagable with the recesses of the connector body for securing the U-shaped member to the connector body.

3. The modular electrical connector of claim 1, further including at least two first mating members, at least two connecting means, and the resiliently biased member being the protruded from the horizontal section.

4. The modular electrical connector of claim 1, wherein the first mating member includes a tab and the second mating member includes a groove.

5. The modular electrical connector of claim 1, wherein the first mating member includes a groove and the second mating member includes a tab.

6. The modular electrical connector of claim 1, further including a layer of conductive coating enclosing a circumferential surface of the hollow cylindrical member.

* * * * *